US011878334B2

(12) United States Patent
Nishimura et al.

(10) Patent No.: US 11,878,334 B2
(45) Date of Patent: Jan. 23, 2024

(54) METHOD OF MANUFACTURING PRESS-FORMED PRODUCT AND PRESS LINE

(71) Applicant: NIPPON STEEL CORPORATION, Tokyo (JP)

(72) Inventors: Ryuichi Nishimura, Tokyo (JP); Toshiya Suzuki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 254 days.

(21) Appl. No.: 17/423,786

(22) PCT Filed: Jan. 16, 2020

(86) PCT No.: PCT/JP2020/001371

§ 371 (c)(1),
(2) Date: Jul. 16, 2021

(87) PCT Pub. No.: WO2020/149381

PCT Pub. Date: Jul. 23, 2020

(65) Prior Publication Data

US 2022/0118499 A1 Apr. 21, 2022

(30) Foreign Application Priority Data

Jan. 17, 2019 (JP) ..... 2019-005940
Feb. 26, 2019 (JP) ..... 2019-032257

(51) Int. Cl.
*B21D 24/10* (2006.01)
*B21D 22/26* (2006.01)
(Continued)

(52) U.S. Cl.
CPC ..... *B21D 24/10* (2013.01); *B21D 22/26* (2013.01)

(58) Field of Classification Search
CPC ..... B21D 24/04; B21D 24/10; B21D 22/20; B21D 22/21; B21D 22/26; B21D 5/01; G05B 2219/37403
(Continued)

(56) References Cited

U.S. PATENT DOCUMENTS

2004/0244458 A1 12/2004 Yamano et al.
2007/0240470 A1 10/2007 Suzuki et al.
(Continued)

FOREIGN PATENT DOCUMENTS

CN 108367328 A 8/2018
DE 19842750 A1 * 4/2000 ..... B21D 22/06
(Continued)

OTHER PUBLICATIONS

English translate (WO2017099128A1), retrieved date May 24, 2023.*
English translate (JP2008173686A), retrieved date May 24, 2023.*
English translate (DE19842750A1), retrieved date May 24, 2023.*

*Primary Examiner* — Matthew Katcoff
*Assistant Examiner* — Mohammed S. Alawadi
(74) *Attorney, Agent, or Firm* — Birch, Stewart, Kolasch & Birch, LLP

(57) ABSTRACT

A method of manufacturing a press-formed product includes: capturing the amount of warp in a sheet to be pressed separately for each sheet; and using a die 6, a punch 7, and a movable mold part to press-form the sheet into a press-formed product. During press-forming, the initial position of the movable mold part 9 relative to the die 6 or punch 7 is controlled depending on the amount of warp in the sheet.

11 Claims, 11 Drawing Sheets

(51) Int. Cl.

| | |
|---|---|
| ***B21D 5/01*** | (2006.01) |
| ***B21D 24/04*** | (2006.01) |
| ***B21D 22/21*** | (2006.01) |

(58) Field of Classification Search
USPC ..... 72/702
See application file for complete search history.

(56) References Cited

U.S. PATENT DOCUMENTS

| | | | | |
|---|---|---|---|---|
| 2016/0221068 | A1* | 8/2016 | Tanaka | B21D 24/04 |
| 2018/0065164 | A1 | 3/2018 | Sumikawa et al. | |
| 2019/0022729 | A1 | 1/2019 | Suzuki et al. | |
| 2019/0176204 | A1 | 6/2019 | Suzuki et al. | |
| 2019/0240941 | A1* | 8/2019 | Schoellhammer | B21D 22/06 |

FOREIGN PATENT DOCUMENTS

| | | | | |
|---|---|---|---|---|
| JP | 2008173686 | A * | 7/2008 | |
| JP | 6179696 | B1 | 8/2017 | |
| JP | 2018-126784 | A | 8/2018 | |
| WO | WO 2005/044481 | A1 | 5/2005 | |
| WO | WO 2016/132905 | A1 | 8/2016 | |
| WO | WO-2017099128 | A1 * | 6/2017 | B21D 22/24 |
| WO | WO 2017/126619 | A1 | 7/2017 | |

* cited by examiner

METHOD OF MANUFACTURING PRESS-FORMED PRODUCT AND PRESS LINE

TECHNICAL FIELD

The present disclosure relates to a method of manufacturing a press-formed product, and a press line.

BACKGROUND ART

Press-forming techniques exist that improve precision in dimensions of a press-formed product using a mold with some parts that are movable. For example, Japanese Patent No. 6179696 (Patent Document 1) discloses press equipment including a die having a die pad and a punch disposed to face the die and having an inner pad.

PRIOR ART DOCUMENTS

Patent Documents

Patent Document 1: Japanese Patent No. 6179696

SUMMARY OF THE INVENTION

Problems to be Solved by the Invention

During press-forming, all the sheets within a given manufacture lot are press-formed under pre-set press conditions. That is, if the deviation of the shape of the first press-formed product from a target shape is within a tolerance, subsequent press-forming is performed under the same press conditions as those for the first press-formed product.

In cases where a plurality of sheets have varying characteristics, the inventors noticed that, even if the press-formed product that was press-formed first has a desired shape, press-formed products that are sequentially press-formed may not have the desired shape.

Herein disclosed is a method of manufacturing a press-formed product that can reduce the deviations of the shapes of a plurality of press-formed products from a target shape, or variations therein, and a press line therefor.

Means for Solving the Problems

A method of manufacturing a press-formed product according to an embodiment of the present invention includes: capturing an amount of warp in one or more sheets to be pressed separately for each sheet; and press-forming the sheet into a press-formed product using a die, a punch and a movable mold part, the movable mold part being capable of changing its position relative to both the die and the punch. During the press-forming, an initial position of the movable mold part relative to the die or the punch is controlled depending on the amount of warp in the sheet.

Effects of the Invention

The present disclosure can reduce the deviations of the shapes of a plurality of press-formed products from a target shape, or variations therein.

EMBODIMENTS FOR CARRYING OUT THE INVENTION

Figure 1:
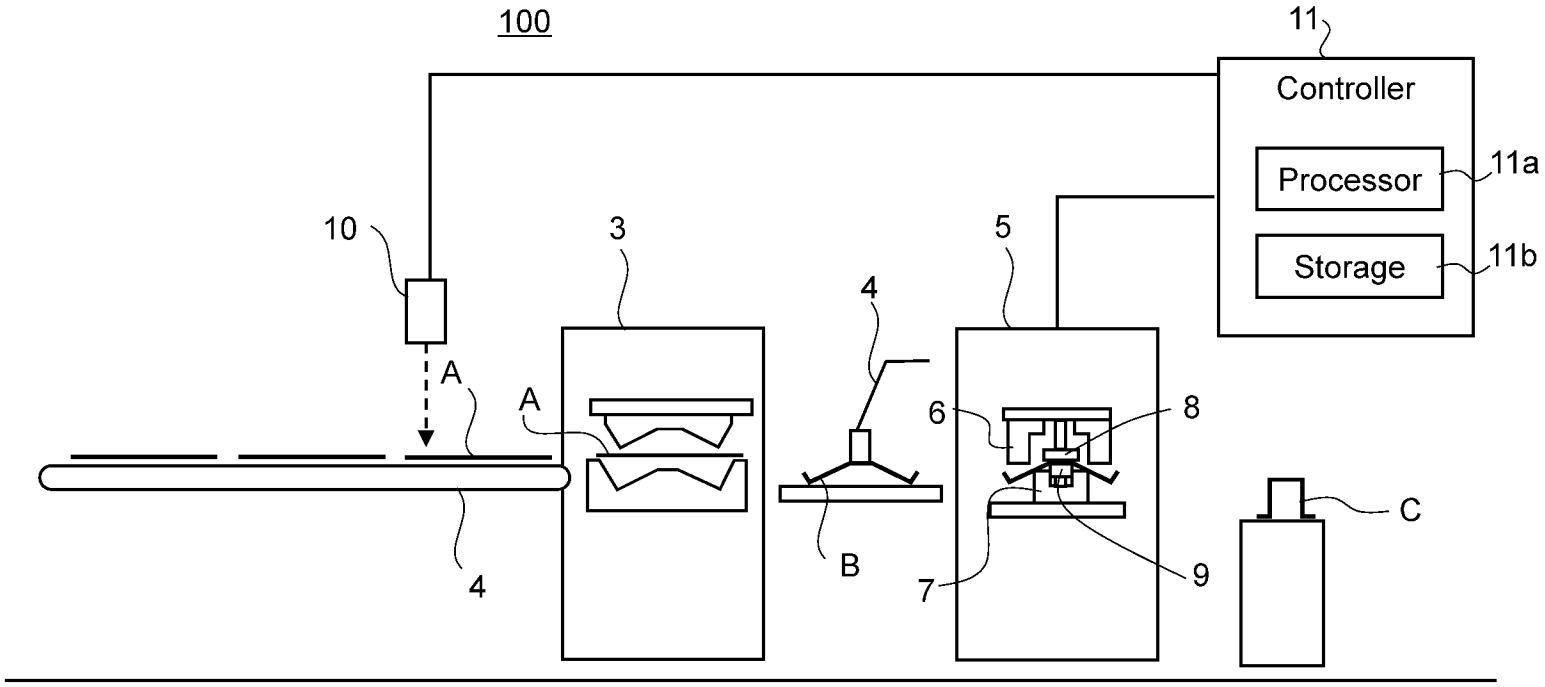
FIG. 1 shows an exemplary configuration of a press line according to an embodiment.

A sheet that is yet to be press-formed is often slightly warped. For example, a plurality of sheets contained in a given manufacture lot usually have different amounts of warp. The inventors focused on such an amount of warp in a sheet. They investigated the relationship between the amount of warp in a sheet before press-forming and the shape of the press-formed product after press-forming, and found out that variations in the amount of warp among a plurality of sheets can cause variations in shape among the resulting press-formed products. They found out that, especially when a grooved member is to be formed by press-forming, the amount of warp in a sheet that is yet to be press-formed is particularly likely to affect the shape of the grooved member that has been press-formed.

In view of this, the inventors attempted to find a way to reduce variations in shape among press-formed products caused by variations in the amount of warp among a plurality of sheets. After intensive investigations, they found that there is a correlation between the amount of warp in a sheet that is yet to be press-formed and the initial position of a movable mold part used for press-forming relative to the die or punch. Based on this finding, they attempted to control the initial position of the movable mold part relative to the die or punch during press-forming depending on the amount of warp in a sheet. They found that controlling the initial position of the movable mold part depending on the amount of warp can reduce variations in shape among press-formed products. They arrived at the following embodiments as specific examples.

(Method 1)

A method of manufacturing a press-formed product according to an embodiment of the present invention includes: capturing an amount of warp in one or more sheets to be pressed separately for each sheet; and press-forming the sheet into a press-formed product using a die, a punch and a movable mold part, the movable mold part being capable of changing its position relative to both the die and the punch. During the press-forming, an initial position of the movable mold part relative to the die or the punch is controlled depending on the amount of warp in the sheet.

The above manufacturing method controls the initial position of the movable mold part relative to the die or punch during press-forming depending on the amount of warp in a sheet. Controlling the initial position adjusts the shape of the press-formed product depending on the amount of warp in the sheet. This will reduce the deviations of the shapes of a plurality of press-formed products from a target shape or variations therein caused by variations in the amount of warp among the plurality of sheets.

The initial position of the movable mold part is the position of the movable mold part relative to the die or punch at an initial stage of each of a plurality of press-forming cycles. For each press-forming cycle, with the movable mold part at the initial position being in contact with the sheet, the die and punch are moved closer to each other to perform press-forming. The initial position of the movable mold part is the position of the movable mold part before the act of moving the die and punch closer to each other.

For example, during press-forming, the movable mold part may be in contact with a portion of the sheet that is to be the relevant portion of the press-formed product (i.e., finished product). In such implementations, the movable mold part controls the shape of the relevant portion of the press-formed product (i.e., finished product). Adjusting the initial position of the movable mold part fine-tunes the shape of the relevant portion of the press-formed product.

The movable mold part may be capable of moving relative to the die or punch during one press-forming cycle. Examples of movable mold parts of this type include punch pads (i.e., inner pads), die pads, and blank holders. Alternatively, the position of the movable mold part relative to the die or punch may be fixed throughout one press-forming cycle. That is, the movable mold part may be incapable of moving (i.e., operating) relative to the die or punch during one press-forming cycle. One press-forming cycle is a press-forming cycle performed by one set of die, punch and movable mold part to fabricate one press-formed product.

(Method 2)

Starting from Method 1 above, the press-forming may include successively press-forming a plurality of sheets. During at least one of the plurality of successive press-forming cycles, the initial position of the movable mold part relative to the die or the punch may be controlled depending on the amount of warp in the sheet. This will reduce variations in shape among a plurality of press-formed products fabricated by a plurality of successive press-forming cycles caused by variations in the amount of warp.

(Method 3)

A method of manufacturing a grooved member according to an embodiment of the present invention is a method of manufacturing a grooved member including a top plate, walls extending from both ends of the top plate, and ridges each located between the top plate and an associated one of the walls. The manufacturing method includes: capturing an amount of warp in a sheet; placing the sheet between a die and a punch, the punch including an inner pad on its top; setting an initial position of the inner pad relative to the punch based on the captured amount of warp; with the initial position of the inner pad relative to the punch having been set, moving the die and the punch closer to each other to form the walls while a die corner (die shoulder) of the die is sliding against the sheet; and, with the inner pad pulled into the punch, compressing the sheet by means of the top of the punch and the die to form the top plate.

The above manufacturing method sets the initial position of the inner pad relative to the punch during press-forming based on the amount of warp in a sheet. The appropriate initial position depending on the amount of warp in the sheet is set. With the initial position of the inner pad set based on the amount of warp, the die and punch move closer to each other, and the walls are formed while the sheet slides against the die corner. Further, with the inner pad pulled into the punch, the sheet is sandwiched between, and pushed by, the punch and die to form the top plate. Thus, controlling the initial position of the inner pad depending on the amount of warp in a sheet adjusts the shape of the press-formed grooved member depending on the amount of warp. This reduces the deviations of the shapes of a plurality of press-formed products from a target shape and variations therein caused by variations in the amount of warp among a plurality of sheets in a manufacture lot.

By way of example, the punch includes a projection protruding toward the die. The die includes a recess corresponding to the projection of the punch. The movable mold part is provided on at least one of the projection of the punch and the recess of the die, for example. The inner pad, which is one example of the movable mold part, is provided on the top of the projection of the punch. The inner pad is provided so as to be capable of protruding from the top of the punch toward the die and capable of being pulled into the top of the punch. The initial position of the inner pad may be set by adjusting the amount of stick-out of the inner pad from the punch, for example. Amount of stick-out of the inner pad is defined as the height of that portion of the inner pad which protrudes from the top of the punch. The die pad, which is one example of the movable mold part, is provided on the bottom of the recess of the die. The die pad is provided so as to be capable of protruding from the bottom of the recess of the die toward the punch.

The amount of warp in the sheet may be measured by measuring the amount of warp therein along at least one direction. To reduce the deviation of a press-formed product from a target shape and variations therein caused by a warp in the sheet, it is preferable to measure the amount of warp in the sheet along two or more different directions. For example, the amount of warp in the sheet may be measured along two different directions in the plane constituted by a surface of the sheet.

The sheet for which the amount of warp is measured is a sheet that is yet to be press-formed by a die and a punch having an inner pad. The sheet for which the amount of warp is measured may be, for example, a blank (i.e., flat sheet), or may be an intermediate-formed product obtained by intermediate-forming a blank. The amount of warp in an entire sheet may be measured, or the amount of warp in some portions of a sheet may be measured. For example, the amount of warp in the portions of the sheet that are to form the walls may be measured. Amount of warp is measured in a sheet that is supposed to be flat (i.e., with an amount of warp of zero), or a portion thereof. For example, the amount of warp may be the amount of deviation from a flat plane.

(Method 4)

Starting form Method 3 above, it is preferable that the amount of warp in the sheet is obtained by measuring a first amount of warp along a direction of extension of the ridges and a second amount of warp along a direction perpendicular to the ridges. This enables controlling the initial position of the inner pad relative to the punch depending on the amounts of warp along directions that are particularly likely to affect the shape of the grooved member. This will further reduce the deviations of the shapes of a plurality of press-formed products from a target shape and variations therein.

(Method 5)

Any one of Methods 1 to 4 above may further include: acquiring correlation data indicating a correlation between the amount of warp in the sheet and the initial position of the movable mold part relative to the die or the punch; and using the correlation data to set the initial position of the movable mold part to correspond to the measured amount of warp in the sheet. The use of correlation data will enable efficiently determining the set value of the initial position of the movable mold part that matches the amount of warp in the sheet.

(Method 6)

Starting from Method 3 or 4 above, the press-forming may form the walls while the die corner of the die is sliding against the sheet along a distance 25 times a sheet thickness of the sheet or larger.

The inventors have found that if, during the press step for forming the walls of a grooved member, the die corner and sheet slide against each other along a distance that is 25 times the sheet thickness of the sheet or larger, variations in the shape of the grooved member caused by a warp in the sheet can easily occur. If the die corner slides along a distance 25 times the sheet thickness of the sheet during formation of the walls, the deviation of the press-formed product from a target shape or variations therein caused by the amount of warp will be reduced more effectively.

Starting from any one of Methods 1 to 6 above, a portion of the sheet with the highest strength may have a tensile strength not lower than 980 MPa. Generally, a sheet having a high strength not lower than 980 MPa tends to have larger variations in the amount of warp than a low-strength sheet. Applying any one of Methods 1 to 6 above to a sheet with a strength not lower than 980 MPa will enable press-forming such a high-strength sheet with reduced deviation of the press-formed product from a target shape or reduced variations therein. The sheet may be a metal sheet. By way of example, the sheet may be a steel sheet.

(Arrangement 1)

A press line according to an embodiment of the present invention includes: a warp-amount capturing device adapted to capture an amount of warp in one or more sheets to be pressed separately for each sheet; press equipment including a die, a punch and a movable mold part capable of moving relative to both the punch and the die; and a controller adapted to control the press equipment. The controller is adapted, during press-forming of the sheet by the die, the punch and the mold part of the press equipment, to control an initial position of the movable mold part relative to the die or the punch depending on the amount of warp in the sheet captured by the warp-amount capturing device.

With Arrangement 1 above, the initial position of the movable mold part relative to the die or punch during press-forming of each sheet is controlled depending on the amount of warp in that sheet on an individual basis. Controlling the initial position in this manner adjusts the shape of a press-formed product depending on the amount of warp in the sheet. This will reduce the deviations of the shapes of a plurality of press-formed products from a target shape or variations therein caused by variations in the amount of warp among a plurality of sheets.

(Arrangement 2)

Starting from Arrangement 1 above, the warp-amount capturing device may be a warp-amount measurement device adapted to measure the amount of warp in the sheet. This will enable efficiently capturing the amount of warp separately for each sheet to be pressed.

(Arrangement 3)

Starting from Arrangement 2 above, the punch may include a top portion, a side wall and a punch ridge located between the top portion and the side wall, and a direction of warp measurement by the warp-amount measurement device may include a direction parallel to the punch ridge and a direction perpendicular to the punch ridge. This will enable controlling the initial position of the movable mold part depending on the amounts of warp along directions that are particularly likely to affect the shape of the press-formed product.

(Arrangement 4)

Starting from any one of Arrangements 1 to 3 above, a height of the side wall of the punch may be 25 times a minimum gap between the punch and the die or larger. In such implementations, if the initial position of the movable mold part is fixed and the die and punch are moved closer to each other to press-form a sheet, the die corner and sheet tend to slide against each other along a distance 25 times the sheet thickness of the sheet or larger. Thus, the deviation of the press-formed product from a target shape and variations therein caused by the amount of warp can be reduced more efficiently. Minimum gap is defined as the gap, i.e., distance, between the die and punch in the press direction as found when the forming assembly is at the bottom-dead center. Press direction is the direction of the movement of the die relative to the punch.

Starting from Arrangements 1 to 4, the press line may further include a controller connected to the warp-amount measurement device and the press equipment. The controller is configured to access a storage device storing correlation data indicating a correlation between the amount of warp in the sheet and the initial position of the movable mold part relative to the die or the punch.

The press line according to an embodiment of the present invention includes: press equipment; a warp-amount measurement device; and a controller connected to the warp-amount measurement device and the press equipment.

The press equipment includes a die and a punch. The punch includes: a top portion; a side wall; a punch ridge located between the top portion and the side wall; and an inner pad provided on the top portion.

A direction of warp measurement by the warp-amount measurement device includes a direction parallel to (of extension of) the punch ridge and a direction perpendicular to the punch ridge.

The controller includes a storage device storing correlation data indicating a correlation between an amount of warp in the sheet along the direction parallel to (of extension of) the punch ridge and an amount of warp in the sheet along the direction perpendicular to the punch ridge measured by the warp-amount measurement device.

In the above arrangement, the direction of warp measurement by the warp-amount measurement device includes a direction parallel to (of extension of) the punch ridge and a direction perpendicular to the punch ridge. The warp-amount measurement device is capable of measuring the amount of warp in a sheet. The warp-amount measurement device is configured to measure the amount of warp along a direction with respect to a sheet corresponding to the punch ridge and along a direction with respect to the sheet corresponding to a direction perpendicular to the punch ridge. The direction with respect to the sheet corresponding to the punch ridge is the direction of the punch ridge as determined with respect to the sheet when the sheet is being press-formed by the press equipment. The press equipment is capable of measuring the amount of warp in a sheet along the direction of the punch ridge and the direction perpendicular to the punch ridge during press-forming of the sheet.

The controller, which is connected to the warp-amount measurement device and press equipment, uses the amount of warp measured by the warp-amount measurement device to control the initial position of the movable mold part relative to the die or punch during press-forming by the press equipment. Further, the controller uses correlation data stored on the storage device to determine the initial position of the movable mold part that matches the amount of warp in the sheet measured by the warp-amount measurement device.

The above arrangement controls the initial position of the movable mold part during press-forming (for example, amount of stick-out of the inner pad from the punch) depending on the amounts of warp in the sheet along directions that are particularly likely to affect the shape of the press-formed product. This will enable reducing the deviations of a plurality of press-formed products from a target shape and variations in shape caused by variations in the amount of warp among a plurality of sheets.

The warp-amount measurement device is configured to measure the amount of warp in a sheet at a location that is upstream of the press equipment. The controller controls the initial position of the movable mold part relative to the die or punch during press-forming of the sheet or an intermediate-formed product obtained by deforming the sheet, i.e., a processed product. For example, the controller may decide, based on the amount of warp, on a set amount of the initial position at which the amount of stick-out (e.g., amount of protrusion) of the inner pad from the punch is fixed, where, with that state kept, the die and punch are moved closer for each other to press-form a sheet.

The warp-amount measurement device may be configured to measure the amount of warp in a sheet that is yet to be placed in the press equipment, or may be configured to measure the amount of warp in a sheet that is placed in the press equipment.

The controller may include a processor and a storage device. The processor executes a program stored on the storage device. The program may be a program that causes the processor to perform a process of controlling the initial position of the movable mold part relative to the punch or die during press-forming of a sheet depending on the amount of warp in the sheet measured by the warp-amount measurement device.

EMBODIMENTS (Press Line)

FIG. 1 shows an exemplary configuration of a press line 100 according to an embodiment. The press line 100 shown in FIG. 1 includes a transportation device 4, intermediate-forming press equipment 3, press equipment 5, a warp-amount measurement device 10, and a controller 11. The warp-amount measurement device 10 is located upstream of the press equipment 5 and intermediate-forming press equipment 3. The warp-amount measurement device 10 measures the amount of warp in a sheet to be pressed (i.e., blank) A, which is a flat sheet. The transportation device 4 transports the blank A to the intermediate-forming press equipment 3. The intermediate-forming press equipment 3 deforms the blank A to provide an intermediate-formed product. In the present implementation, an intermediate-formed product that has been press-formed by the intermediate-forming press equipment 3 is press-formed by the press equipment 5 to provide a grooved member. The transportation device 4 transports the intermediate-formed product, i.e., sheet to be pressed B, from the intermediate-forming press equipment 3 to the press equipment 5.

The transportation device 4 may be, for example, a conveyor including a transportation route leading to the intermediate-forming press equipment 3 or press equipment 5. In such implementations, the transportation route of the transportation device 4 leading to the intermediate-forming press equipment 3 may be positioned to pass through the measurement region for the warp-amount measurement device 10. The transportation device 4 is not limited to a conveyor. For example, the transportation device 4 may be a manipulator constituted by an articulated robot. For example, the manipulator transports a sheet placed on a material table, or on a mold, positioned upstream of the intermediate-forming press equipment 3 or press equipment 5 to the press equipment 5. The warp-amount measurement device 10 may be positioned to be capable of measuring the amount of warp in a sheet to be pressed being transported on a material table or by a manipulator. Alternatively, the transportation device 4 may be an unmanned or manned forklift.

The press equipment 5 press-forms a sheet to be pressed B to provide a press-formed product C. "Sheet to be pressed A" and "sheet to be pressed B" will be hereinafter referred to simply as "sheet A" and "sheet B". In the present implementation, the press-formed product C constitutes the grooved member. The press equipment 5 includes a mold composed of a die 6, a punch 7, a die pad 8, and a punch inner pad 9. The die pad 8 and punch inner pad 9 are capable of changing their positions relative to both the die 6 and punch 7. The press equipment 5 places the sheet B between the die 6 and punch 7 and pushes the sheet B by means of both the die 6 and punch 7 to press-form the sheet B.

Specifically, the press equipment 5 press-forms the sheet B by means of the die 6 and punch 7 while moving the die 6 and punch 7 relative to each other to push the punch 7 into the interior of the die 6. A press-forming process for producing one press-formed product includes a step in which, with the punch inner pad 9 being in contact with the sheet B and the position of the punch inner pad relative to the punch 7 fixed at a set position (i.e., initial position), the die 6 and punch 7 are moved closer to each other such that the die 6 and punch 7 push the sheet B (i.e., first press step). Further, the press-forming process includes a step in which, while the punch inner pad 9 is being pulled into the punch 7, the die 6 and punch 7 are moved closer to each other to press-form the sheet B (i.e., second press step). The press-forming process further includes a step in which, with the punch inner pad 9 pulled into the punch 7, the punch 7 and die 6 compress the sheet B to press-form the sheet B (i.e., third press step).

The press-formed product C, i.e., grooved member, includes a top plate, walls adjacent to the top plate, and ridges each located between the top plate and the associated one of the walls. The first and second press steps mainly form the walls. The third press step mainly forms the top plate.

The warp-amount measurement device 10 may be configured, for example, to use an optical sensor against a side of a sheet to obtain an image of the side of the sheet and measure the amount of warp in that image. Alternatively, the warp-amount measurement device 10 may use a camera or laser displacement meter to measure the shape of the front or back face of the sheet, or both of them, to measure the amount of warp in the sheet. The measurement of the shape of the surface of the sheet may use, for example, optical cutting, the phase shift method, or stereo matching, for example. The warp-amount measurement device 10 may, for example, measure the maximum displacement of the surface of the sheet from a reference plane and treat it as the amount of warp in the sheet. By way of example, a laser displacement meter may access one of the faces of a sheet and use optical cutting to measure the inclination angles, as observed in one plane, of two portions spaced apart from each other by a certain distance. This angle may be converted to an amount of warp.

The warp-amount measurement device 10 is configured to measure the amount of warp in a sheet along two or more directions. For example, the warp-amount measurement device 10 is configured to measure the amount of warp in a sheet along two directions that are in the plane constituted by a surface of the sheet and are perpendicular to each other. For example, in implementations where a sheet is press-formed into a grooved member, the warp-amount measurement device 10 may be configured to measure the amount of warp in a sheet along each of the direction of the line constituted by a ridge of the grooved member and the direction perpendicular to that line.

The controller 11 is connected to the press equipment 5 and warp-amount measurement device 10. The controller 11 may be connected to the press equipment 5 and warp-amount measurement device 10 via a cable, or may be wirelessly connected. The controller 11 is capable of communicating with the press equipment 5 and warp-amount measurement device 10. The controller 11 may be incorporated into the press equipment 5 or warp-amount measurement device 10, or may be an independent device.

The controller 11 may be constituted by, for example, a computer including a processor 11*a* and a storage device 11*b* (i.e., memory). The processor 11*a* is capable of performing the functions of the controller 11 by executing a program stored on the storage device 11*b*. The controller 11 uses data relating to the amount of warp in a sheet (i.e., blank) A measured by the warp-amount measurement device 10 to control the initial position of the movable mold part relative to the die or punch during press-forming (e.g., position of the punch inner pad 9 relative to the punch 7, i.e., amount of stick-out of the inner pad 9 from the punch 7). Specifically, the controller 11 sets the initial position of the movable mold part based on data relating to the amount of warp in a sheet (i.e., blank) A measured by the warp-amount measurement device 10.

The initial position of the movable mold part set by the controller 11 may be, for example, a set amount at which the amount of stick-out of the punch inner pad 9 from the punch 7 is fixed, where, with that state kept, the die 6 and punch 7 are moved closer to each other for press-forming (i.e., first press step, discussed above). That is, the set amount of the amount of stick-out for the first press step is controlled by the controller 11.

The controller 11 may use, for example, correlation data, stored on the storage device 11*b* in advance, indicating the correlation between an amount of warp and an initial position of the movable mold part to determine the initial position of the movable mold part (i.e., amount of stick-out of the punch inner pad from the punch) that matches an amount of warp measured. The correlation data indicates the correspondence between the initial position of the movable mold part (e.g., amount of stick-out of the punch inner pad 9 from the punch 7 during press-forming (for example, during the first press step)), on one hand, and the amount of warp in a sheet, on the other. Specifically, the correlation data may indicate the correlation (i.e., correspondence) between a value indicating the amount of warp in a sheet obtained by measurement, on one hand, and a value for controlling the initial position of the movable mold part during press-forming. The correlation data is not limited to any particular data format. The correlation data may be data (e.g., table data or map data) for associating a value indicating the amount of warp in a sheet with a value for controlling the initial position of the movable mold part. Alternatively, the correlation data may be data (e.g., functions, programs, or parameters therefor) indicating a procedure for the processor for calculating values for controlling the initial position of the movable mold part using values indicating the amount of warp in a sheet. The correlation data may be created, for example, based on the amounts of warp in a plurality of sheets (e.g., test blanks) that have been previously measured, the initial positions of the movable mold part during press-forming of those sheets, and the shapes of the press-formed products obtained from those press-forming cycles.

For example, the controller 11 obtains, from the warp-amount measurement device 10, data indicating the amount of warp in a sheet (i.e., blank) A that has been measured. The controller 11 uses the correlation data to convert the values indicating the amount of warp in the sheet (i.e., blank) A to control values indicating the initial position of the movable mold part. The controller 11 controls the press equipment 5 in such a manner that the initial position of the movable mold part during press-forming matches the position indicated by the control values.

For example, the press equipment 5 manufactures a plurality of press-formed products by press-forming, in a repetitive manner, a plurality of sheets B that have been obtained by processing a plurality of blanks A contained in a manufacture lot. The controller 11 may set the initial position of the movable mold part for each of the sheets B to be press-formed. To set the initial position of the movable mold part for one particular sheet B to be press-formed, the controller 11 uses data indicating the amount of warp in the blank A from which this particular sheet B was made. This enables feedforward control of the initial position of the movable mold part depending on the amount of warp in a blank A. Alternatively, the warp-amount measurement device 10 may measure the amount of warp in an intermediate-formed product, i.e., sheet B, rather than a blank A. In such implementations, the controller 11 sets the initial position of the movable mold part based on the amount of warp in the intermediate-formed product, i.e., sheet B.

(Exemplary Configuration of Press Equipment and Warp-Amount Measurement Device)

Figure 2:
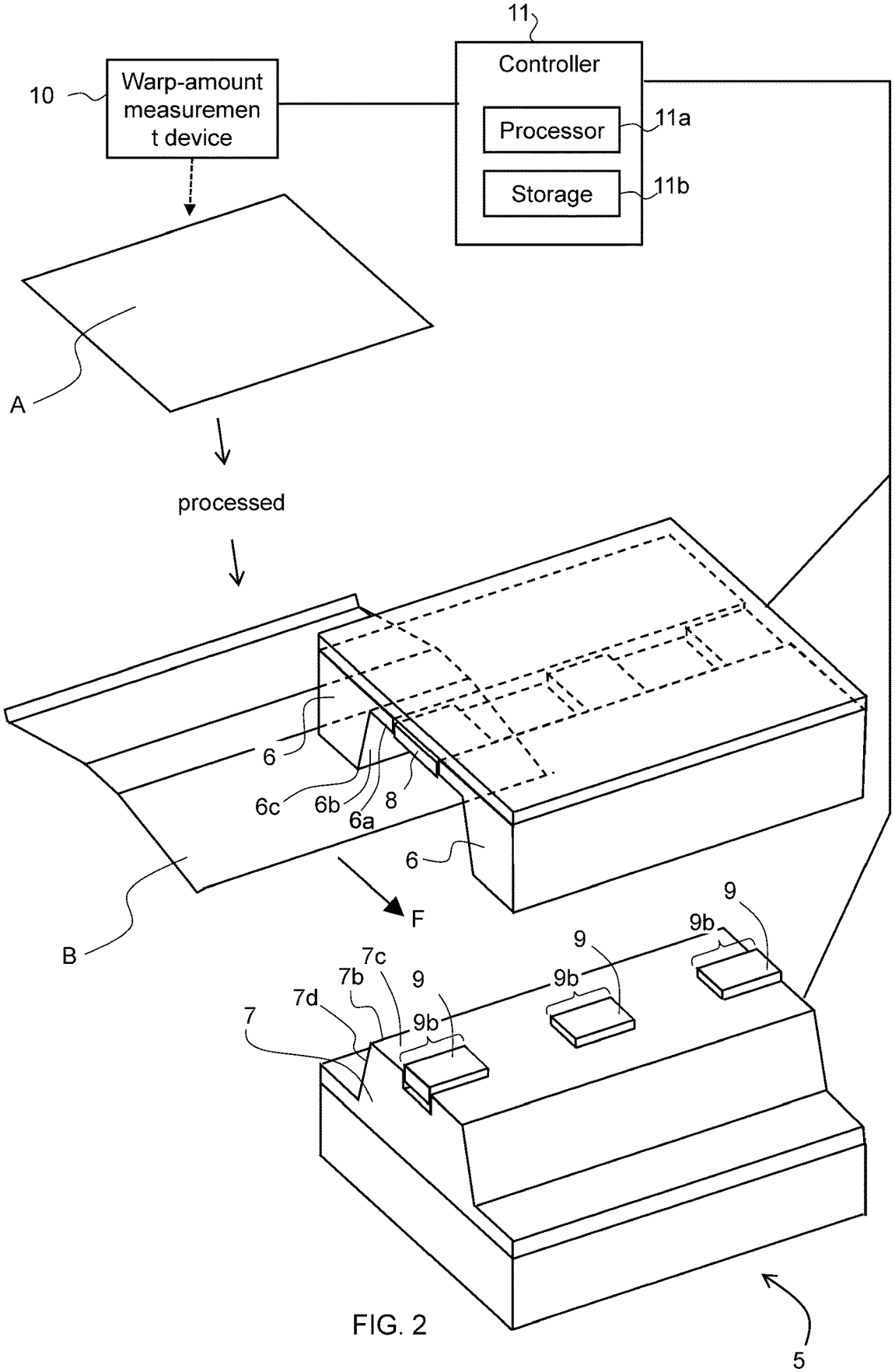
FIG. 2 is a perspective view of an exemplary configuration of press equipment.

FIG. 2 is a perspective view of an exemplary configuration of press equipment 5 having movable mold parts. In the implementation shown in FIG. 2, the mold having movable parts includes: a die 6 having a recess; a punch 7 having a projection corresponding to the recess of the die 6; and a die pad 8 and a punch inner pad 9 capable of moving relative to the die 6 and punch 7. The die pad 8 forms part of the recess of the die 6, and is capable of protruding from the recess of the die 6 toward the punch 7. The punch inner pad 9 forms part of the projection of the punch 7, and is capable of protruding from the projection of the punch 7 toward the die 6.

The projection of the punch 7 includes a top portion 7*c*, side walls 7*d* adjacent to the top portion 7*c*, and punch ridges 7*b* each located between the top 7*c* and the associated one of the side walls 7*d*. In the implementation shown in FIG. 2, a plurality of punch inner pads 9 are provided. The punch inner pads 9 are arranged in the direction of extension of the punch ridges 7*b*, spaced apart from one another. A punch inner pad 9 may extend the entire dimension of the punch 7 as measured in the direction of the punch ridges 7*b*.

The recess of the die 6 includes a bottom portion 6*a*, side walls 6*b* adjacent to the bottom portion 6*a*, and die corners 6*c* represented by the edges of the recess. The die corners 6*c* form the die ridges. The direction of extension of the die ridges is generally the same as the direction of extension of the punch ridges 7*b*. A plurality of die pads 8 are provided. The die pads 8 are located at positions corresponding to the respective punch inner pads 9. The die pads 8 are arranged in the direction perpendicular to the direction of transportation of the sheet, spaced apart from one another. A die pad 8 may extend the entire dimension of the die 6 as measured in the direction of extension of the punch ridges 7*b*.

The sheet B is transported between the die 6 and punch 7. The direction of transportation of the sheet B, F, is generally perpendicular to the direction of extension of the punch ridges 7*b* and die corners 6*c*. The sheet B is placed between the die 6 and punch 7, and pushed by the die 6 and punch 7 for press-forming. As a result of the press-forming, the sheet B becomes a grooved member. During the step of press-forming, the die corners 6*c* push the sheet B while sliding against the sheet B, thus performing press-forming. Further, the sheet B is pushed against the punch ridges 7*b* such that ridges are formed in the sheet B. Thus, the direction of extension of the ridges between the top plate and walls of the press-formed grooved member aligned with the direction of extension of the punch ridges 7*b*.

The warp-amount measurement device 10 measures the amount of warp in the sheet (i.e., blank) A along the direction of the lines formed by the ridges of the grooved member and along the direction perpendicular thereto. That is, the device measures the amount of warp in the sheet (i.e., blank) A along the direction of the lines that are to be abutted by the punch ridges 7*b* during press-forming and along the direction perpendicular thereto.

Figure 3A:
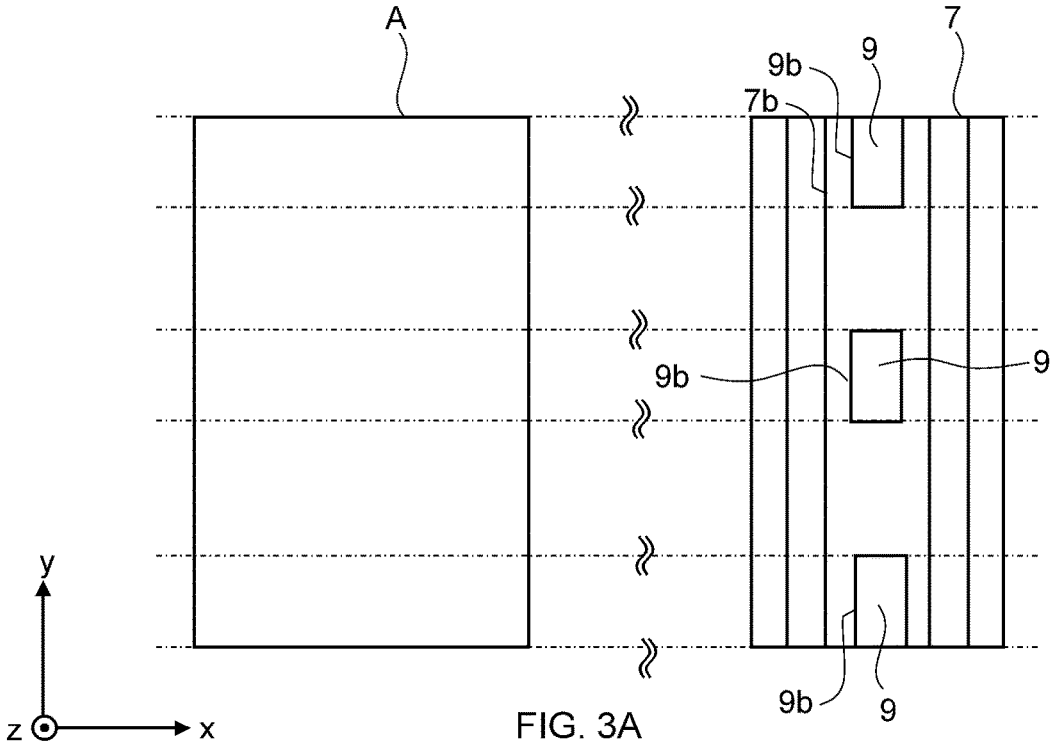
FIG. 3A illustrates an exemplary relationship between the direction of measurement of the amount of warp in a sheet to be pressed and the direction of the punch ridges.

FIG. 3A illustrates an exemplary relationship between the direction of measurement of the amount of warp in the blank A and the direction of the punch ridges 7*b* during press-forming. FIG. 3A shows the blank A and punch 7 as viewed from above. In FIG. 3A, a surface of the blank A provides the xy-plane, while the direction perpendicular to the xy-plane provides the z-direction. The x- and y-directions are perpendicular to each other. In the implementation shown in FIG. 3A, the amount of warp is measured along each of the two directions perpendicular to each other in the plane provided by the blank A (i.e., x- and y-directions). The blank A is processed into the sheet B. The sheet B is positioned between the punch 7 and die 6 in such a manner that one of the two directions along which the amount of warp in the sheet B has been measured (i.e., x- and y-directions) is the same as the direction of extension of the punch ridges 7*b*. This enables measurement of the amount of warp along the direction of extension of the ridges of the grooved member and the amount of warp along the direction perpendicular to the ridges of the grooved member.

Figure 3B:
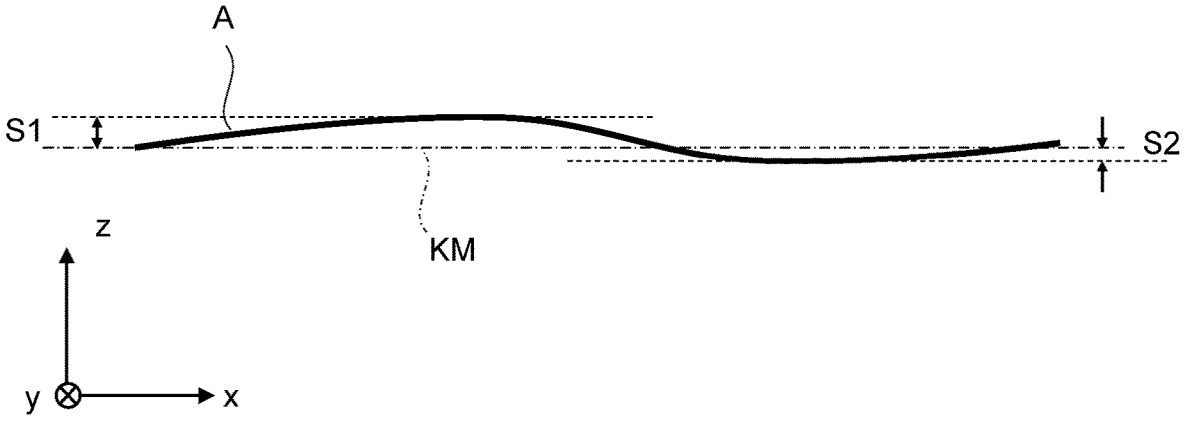
FIG. 3B illustrates an exemplary measurement, along the x-direction, of the amount of warp in a sheet to be pressed in connection with FIG. 3A.

FIG. 3B illustrates measurement of the amount of warp in a sheet (i.e., blank) A along the x-direction in connection with FIG. 3A. In the implementation shown in FIG. 3B, for each of the points arranged in the x-direction, the displacement of the surface of the sheet A from the reference plane KM is measured. For example, the amount of warp along the x-direction can be determined based on the maximum displacement S1 above the reference plane KM and on the maximum displacement below the reference plane KM. The reference plane KM may be, for example, a pre-set plane in the measurement system for the warp-amount measurement device 10, or may be decided based on the measurement positions constituted by a plurality of points in the sheet A. Thus, the amount of warp in a sheet along one direction can be measured based on the distribution of the displacement of the sheet from a reference plane along one direction. The amount of warp along two or more directions can be measured in analogous manners.

Figure 3C:
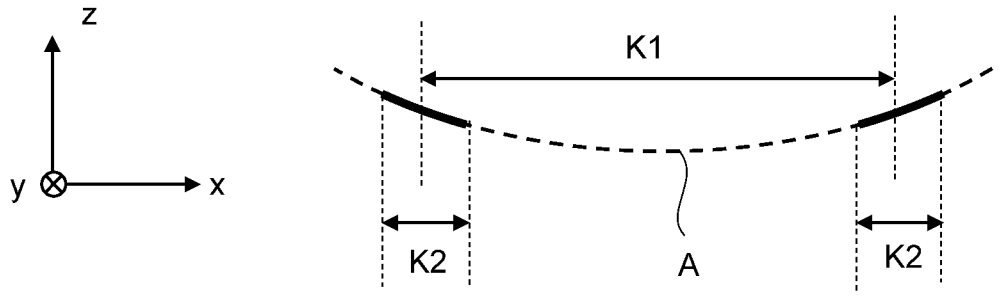
FIG. 3C illustrates another exemplary measurement of the amount of warp in a sheet to be pressed.

FIG. 3C illustrates another exemplary measurement of the amount of warp in a sheet. The implementation shown in FIG. 3C measures the angle between two portions of a sheet A spaced apart by a specified distance K1 in the x-direction, as measured in a cross section represented by an xz-plane. The distance K1 may be approximately 110 mm, for example. The dimension of each of the measured portions in the x-direction, K2, may be approximately 5 mm, for example. The integral of the amount of warp represents the change in angle. Measuring the change in angle enables measurement of the average amount of warp in a specified segment. In other implementations, the z-coordinates of three points spaced apart from one another may be measured. In such implementations, expressing the surface of a sheet as a uniform arc-shaped curved line allows the average amount of warp to be calculated from the measurements for the three points. The measurement of the amount of warp is not limited to these exemplary methods.

(Exemplary Press-Forming Process)

FIGS. 4A to 4D illustrate an exemplary press-forming process. By way of example, an exemplary press-forming process by the press equipment 5 shown in FIGS. 1 and 2 will be described. In the implementation shown in FIGS. 4A to 4D, the die pad 8 is positioned inside the die 6 to be movable in the direction in which the sheet is pressed. As used herein, direction in which the sheet is pressed means the direction in which the die 6 moves relative to the punch 7. The punch inner pad 9 can be positioned so as to protrude outwardly from the pressing surface 7*a* of the punch 7, and can be pushed in to be at the same height as the pressing surface 7*a* of the punch 7. The surface (i.e., top surface) of the top 7*c* of the punch 7 constitutes the pressing surface 7*a*.

The punch inner pad 9 is capable of being moved in the vertical direction (i.e., press direction) relative to the punch 7 by means of, for example, a lift mechanism such as a gas spring 9*s* or a cushion mechanism in the press equipment. The die pad 8 is placed, for example, on a slide 6*d* in the press equipment, with a lift mechanism such as a gas spring 8*s* provided therebetween. The die 6 is secured to the slide 6*d*. The die pad 8 is movable in the vertical direction together with the slide 6*d*. The gas spring 8*s* makes the distance between the die pad 8 and slide 6*d* extendable. The bottom portion 6*a* of the recess of the die 6 includes a recess in which the die pad 8 can be contained. The punch inner pad 9 is located inside a recess formed in the pressing surface 7*a* of the punch 7. The punch inner pad 9 is biased upward by the gas spring 9*s* located inside that recess. Biasing by the gas spring 9*s* makes the top surface of the punch inner pad 9 protrude outwardly from the pressing surface 7*a* of the punch 7. Extension and contraction of the gas spring 9*s* changes the distance between the punch 7 and punch inner pad 9.

With the die pad 8 and punch inner pad 9 being pushed against the sheet B, they are capable of moving relative to the die 6 or punch 7. For example, the die 6 may be moved closer to the punch 7 while the die pad 8 and punch inner pad 9, sandwiching the sheet B, remain stationary. When the die pad 8 and punch inner pad 9 sandwiching the sheet B remain stationary while the slide 6*d*, i.e. die 6, is moving closer to the punch 7, the gas spring 8*s* (i.e., lift mechanism) of the die pad 8 contracts. When the die pad 8 moves closer to the punch 7 while the die 6 is moving closer to the punch 7, the gas spring 8*s* (i.e., lift mechanism) of the die pad 8 does not extend nor contract.

With the punch inner pad 9 protruding outwardly from the pressing surface 7*a* of the punch 7, the press equipment 5 pushes the punch inner pad 9 and die pad 8 against the sheet B and, while keeping this state, moves the die 6 and punch 7 closer to each other to press-form the sheet B. The equipment keeps press-forming the sheet B until the punch inner pad 9 is at the same height as the pressing surface 7*a* of the punch 7, that is, the forming assembly is at the bottom-dead center. When the forming assembly is at the bottom-dead center, the sheet B is sandwiched between the punch 7 and die 6, with the punch inner pad 9 contained in the punch 7 and with the die pad 8 contained in the die 6.

Figure 4A:
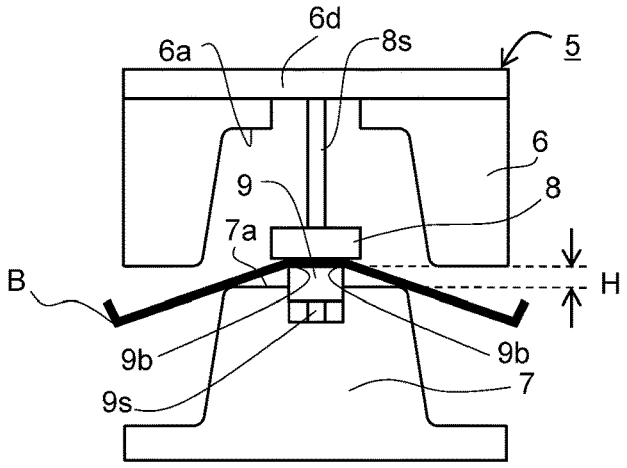
FIG. 4A illustrates an exemplary press-forming process.
Figure 4B:
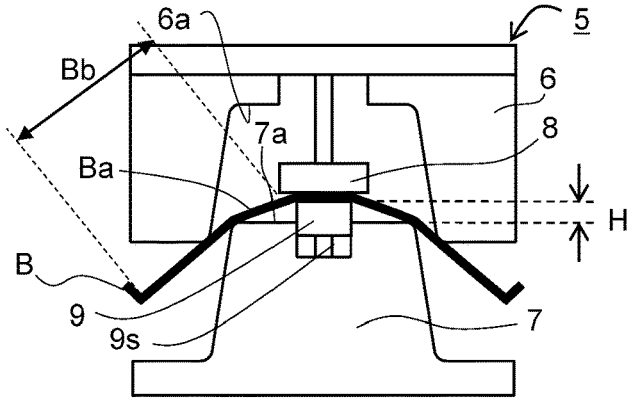
FIG. 4B illustrates the exemplary press-forming process.
Figure 4C:
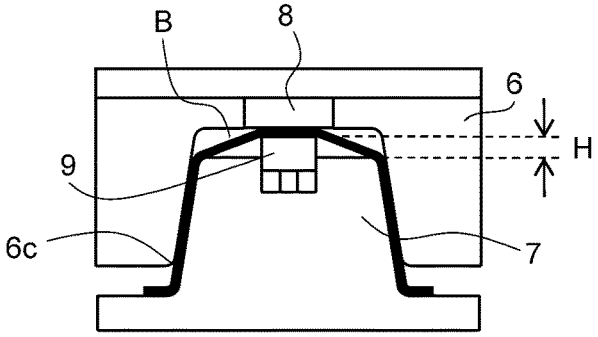
FIG. 4C illustrates the exemplary press-forming process.

Specifically, first, as shown in FIG. 4A, with the punch inner pad 9 protruding outwardly from the pressing surface 7*a* of the punch 7, the die pad 8 is pushed against the sheet B and, with this state being kept, the die 6 and die pad 8 are lowered to press-form the sheet B between the die 6 and punch 7. During this, the amount of stick-out of the punch inner pad 9 from the punch 7 i.e., the height of the top surface of the punch inner pad 9 relative to the pressing surface 7*a* of the punch 7 (i.e., amount of protrusion), H, is fixed at a set value. The amount of protrusion H is set based on the amount of warp in a blank A that is yet to be processed into a sheet B, measured prior to press-forming. The sheet B to be formed develops a sag Ba that depends on the amount of stick-out (i.e., amount of protrusion) H of the punch inner pad 9 from the punch 7. Then, beginning with this state, as shown in FIG. 4B, the die 6 is lowered to continue press-forming while the sag Ba in the sheet B is controlled within a predetermined amount. As shown in FIG. 4C, the die 6 is lowered down to a point directly before the forming bottom-dead center, H (i.e., point distant from the forming bottom-dead center by H). During this, the press mechanism of the die pad 8 contracts while the die 6 is being lowered.

Figure 4D:
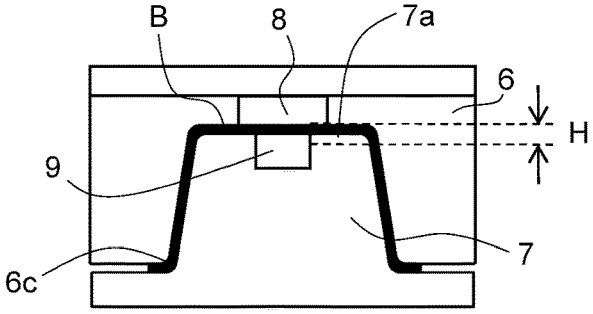
FIG. 4D illustrates the exemplary press-forming process.

During the steps shown in FIGS. 4A to 4C, the die 6 and punch 7 are moved closer to each other while the amount of stick-out, i.e., amount of protrusion, H of the punch 7 from the punch inner pad 9 remains fixed at a set value (i.e., value indicating the initial position). At the stage shown in FIG. 4C, where the die pad 8 is in contact with the bottom of the die and thus is completely pulled into the die 6 (i.e., point before the forming bottom-dead center by the amount of protrusion H), the distance between the top surface of the punch inner pad 9 and the pressing surface 7*a* of the punch 7 begins to contract. The position of the punch 7 relative to the punch inner pad 9 changes from the stage of FIG. 4C until the stage of FIG. 4D. As shown in FIG. 4D, the sheet B is press-formed until the top surface of the punch inner pad 9 is at the same height as the pressing surface 7*a* of the punch 7. During this, the sag Ba in the sheet B, while receiving in-plane compressive stress, is forced to flow out toward the walls between the punch 7 and die 6. This results in the press-formed product with a hat-shaped cross section.

In the implementation shown in FIGS. 4A to 4D, the sag Ba developed in the sheet B is crushed and forced to flow toward the walls to increase inwardly bent regions, i.e., regions that contribute to spring-go. This enables balancing spring-back and spring-go in the material being press-formed. This will reduce irregularities in the shape of the walls.

Further, during the press-forming process from FIG. 4A to 4D, the outer portions Bb of the sheet B located outward of the portion sandwiched by the die pad 8 and punch inner pad 9 are pressed while sliding against the die 6 and punch 7. It has been recognized that the warp in the portions Bb of the sheet that slide against the die 6 or punch 7 during press-forming is particularly likely to affect the shape of the press-formed product. Thus, control of the amount of stick-out H depending on the amount of warp is more effective if the die corner 6*c* of the die 6 and the sheet B slide against each other along a distance that is 25 times the sheet thickness of the sheet B or larger.

The above exemplary process is a process for press-forming one sheet B, including: with the amount of stick-out of the punch inner pad 9 from the punch 7 being fixed (i.e., under initial press settings), the step of moving the die 6 closer to the punch 7 to press-form the sheet B; and the step of moving the die 6 closer to the punch 7 while changing the amount of stick-out of the punch inner pad 9 from the punch 7, thereby press-forming the sheet B. The amount of stick-out of the punch inner pad 9 from the punch 7, i.e., amount of protrusion H of the punch inner pad 9, under the initial press settings is controlled by the controller 11. The amount of protrusion H is an exemplary value indicating the initial position of the movable mold part.

The controller 11 decides the amount of protrusion H of the punch inner pad 9 based on the measured amount of warp of the sheet (i.e., blank) A. The implementation shown in FIG. 3A measures the amount of warp in the sheet (i.e., blank) A along the direction of extension of the ridges of the press-formed product i.e. grooved member, that is, the direction of extension of the punch ridges 7*b*, and along the direction perpendicular thereto. This will enable controlling the amount of protrusion H of the punch inner pad 9 depending on the amounts of warp in the sheet (i.e., blank) A along directions that are particularly likely to affect the shape of the press-formed product.

The press-forming process using a movable mold part is not limited to the above exemplary one. For example, the press equipment can be modified by omitting the die pad 8. Further, the above exemplary process press-forms a sheet B that is an intermediate material that has been bend-formed in advance; alternatively, the press equipment may press-form a flat sheet, i.e., blank A, that has not been bend-formed.

Typically, for bend-forming, a die pad is often provided to prevent positional displacement of the sheet from the punch inner pad. In other words, in the case of a shape that prevents positional displacement, the die pad may be omitted. The exemplary forming process shown in FIGS. 4A to 4D, too, can be modified by omitting the die pad 8. If the die pad 8 is omitted from the exemplary forming process shown in FIGS. 4A to 4D, from the initial forming stage up to the stage shown in FIG. 4C, the portion corresponding to the die pad 8, pulled into the recess of the die 6, is integral with the die. From the initial forming stage up to the stage shown in FIG. 4C, portions of the sheet B located in the middle as determined in the width direction in a cross section, are raised from below by the punch inner pad 9, as in implementations with the die pad 8, and the press-forming process progresses while keeping that state. After the stage shown in FIG. 4C, the punch inner pad 9 is pushed downwardly by the die 6 and is thus lowered, and the press-forming is completed, as in FIG. 4D.

(Exemplary Press-Formed Product)

Figure 5:
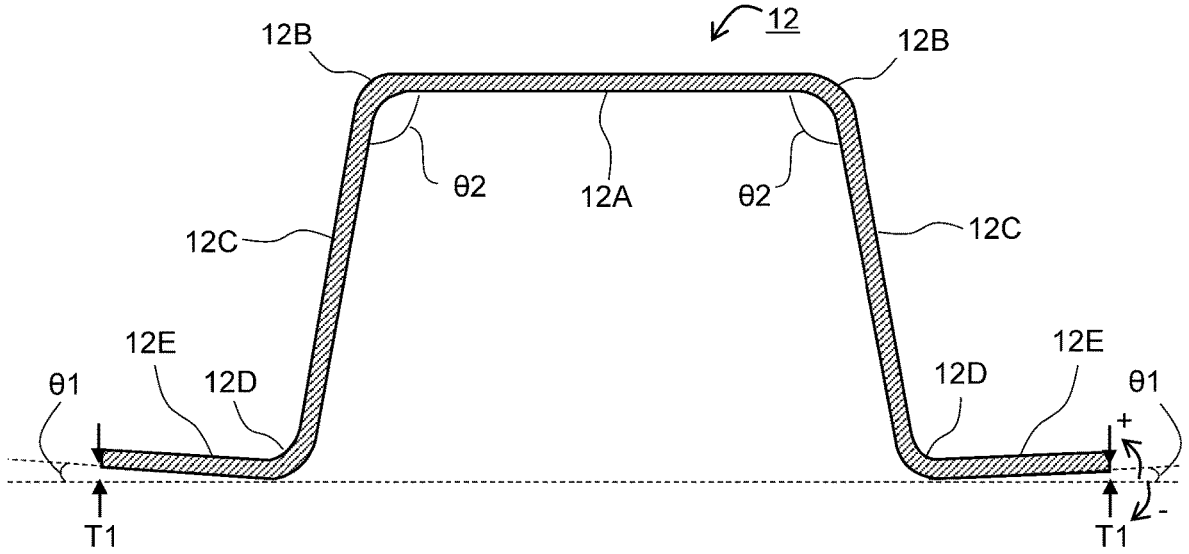
FIG. 5 is a cross-sectional view of an exemplary press-formed product.

FIG. 5 is a cross-sectional view of an exemplary press-formed product. The press-formed product 12 shown in FIG. 5 may be obtained, for example, by the press-forming process shown in FIGS. 4A to 4D. The press-formed product 12 is an example of the grooved member. The press-formed product 12 has a hat-shaped cross section. The press-formed product 12 is a long member with its longitudinal direction represented by the direction perpendicular to the cross section shown in FIG. 5. It includes a top plate 12A extending in the width direction of the press-formed product 12, and a pair of ridges 12B adjacent to both ends, as determined in the width direction, of the top plate 12A. Further, the press-formed product 12 includes a pair of walls 12C extending from the respective ridges 12B in the direction away from the back surface of the top plate 12A (i.e., one sheet-thickness direction), and a pair of ridges 12D adjacent to the ends (i.e., lower ends) of the pair of walls 12C. Furthermore, the press-formed product 12 includes a pair of flanges 12E extending from the respective ridges 12D in the respective width directions of the top plate 12A. The angle formed by the top plate 12A and walls 12C, θ2, is not limited to 90 degrees. An exemplary range of the angle θ2 may be 90 to 125 degrees. During high deformation with this range, problems such as spring-back become particularly significant; thus, the above-discussed control of the amount of stick-out depending on the amount of warp will be advantageous. An acute angle θ2, below 90 degrees, may cause problems with removal of the press-formed product from the mold.

In the press-formed product 12, the angle θ1 formed by the top plate 12A and a flange 12E, for example, may be measured. In this implementation, spring-back occurs when each angle θ1, formed by the top plate 12A and a flange 12E, is larger than a predetermined reference value θc indicating the desired shape, i.e., 0 degrees in this case (θ1>θc (=0 degrees)), and spring-go occurs when 01 is smaller than the reference angle θc (θ1<θc (=0 degrees)). The value indicating the degree of spring-back or spring-go is not limited to the angle θ1 of the above implementation. For example, the angle formed by the top plate 12A and a flange 12E, θ2, or the height difference in the bottom surface of a flange 12E as measured in the vertical direction, T1, may be measured to provide a value for indicating the degree of spring-back or spring-go.

(Exemplary Operation)

Figure 6:
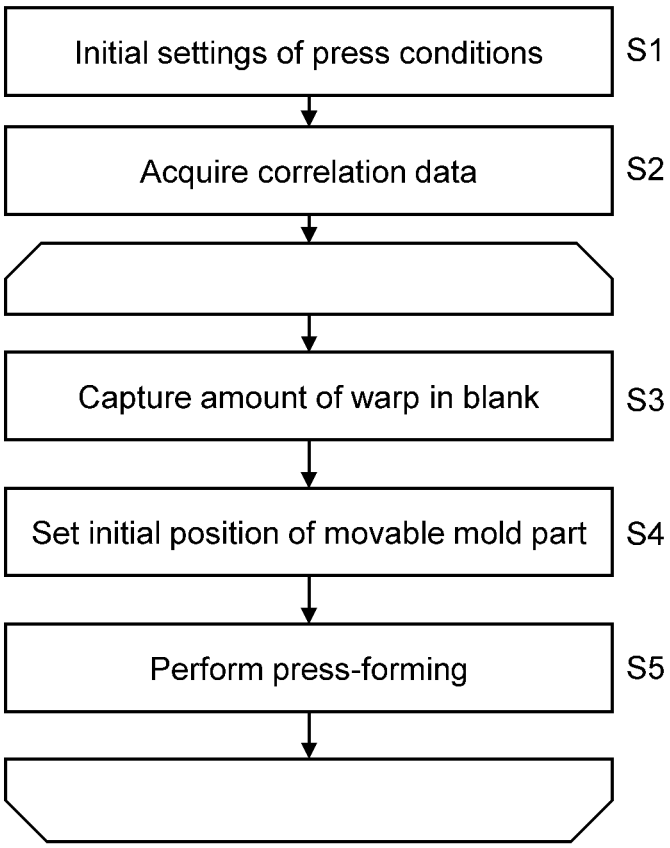
FIG. 6 is a flow chart illustrating an exemplary operation of the controller.

FIG. 6 is a flow chart illustrating an exemplary operation of the controller 11 according to the present embodiment. In the implementation shown in FIG. 6, first, the controller 11 makes initial settings for press conditions (S1). The press conditions include, for example, the initial position of the movable mold part relative to the die or punch (e.g., amount of stick-out of the punch inner pad 9 from the punch). One exemplary initial position of the movable mold part that is set is the initial value of the amount of protrusion H of the punch inner pad 9, discussed above. The press conditions are not limited to the initial position of the movable mold part.

The controller 11 acquires correlation data that has been provided by calculation in advance (S2). For example, the controller 11 determines the correlation data to be used for the feedforward process and makes it accessible. For example, the computer of the controller 11 extracts correlation data to be used for the process from the data that has been stored in advance on a storage medium accessible to itself (i.e., storage device incorporated in the controller 11 or an external one), and stores it on memory (i.e., storage device 11*b*). The correlation data is created in advance prior to press-forming, and is stored on a storage medium accessible to the controller 11.

At S3 of FIG. 6, the warp-amount measurement device 10 acquires the measurement of the amount of warp in a sheet B that is to be transported next to the press equipment 5. The controller 11 acquires the measurement of the amount of warp in the sheet from the warp-amount measurement device 10. By way of example, as shown in FIGS. 1 and 2, the amount of warp in the sheet (i.e., blank) A is measured at a location upstream of the press equipment 5. The data indicating the amount of warp in the sheet (i.e., blank) A is stored, for example, on a storage device accessible to the controller 11. The controller 11 acquires, from the storage device, the data indicating the amount of warp in the sheet (i.e., blank) A from which the sheet B to be transported next to the press equipment 5 was made.

Based on the amount of warp acquired at S3, the controller 11 sets the initial position of the movable mold part, e.g., the amount of stick-out (i.e., amount of protrusion H) of the punch inner pad 9 relative to the punch (S4). The controller 11 controls the press equipment 5 to adjust the amount of protrusion H of the punch inner pad 9 relative to the punch 7 to the value that has been set based on the amount of warp. The controller 11 performs press-forming while controlling the amount of protrusion H (S5). At S5, the sheet B obtained by processing the blank A for which the amount of warp was captured at S3 is subjected to press-forming with the amount of stick-out (i.e., amount of protrusion H) of the punch inner pad 9 set at S4.

The process from S3 to S5 in FIG. 6 is repeated for each of a plurality of sheets contained in one manufacture lot. Thus, for each sheet to be press-formed in one manufacture lot, feedforward control is possible based on the amount of warp in the sheet.

Figure 7:
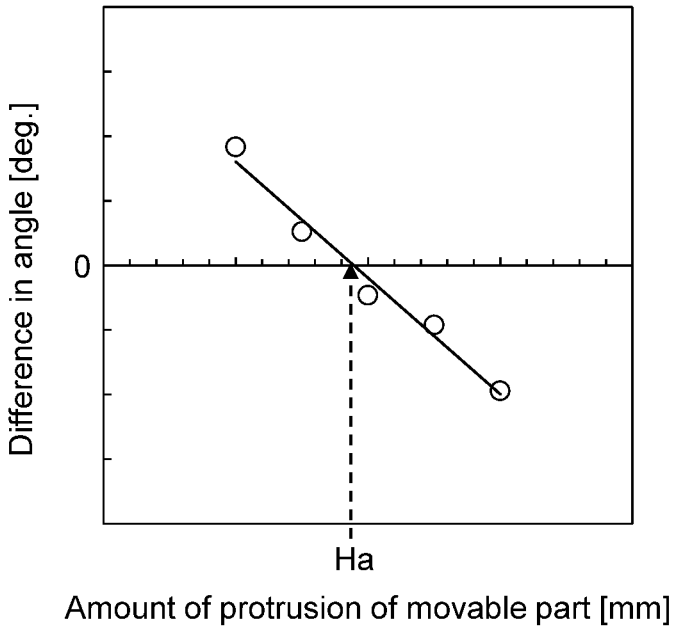
FIG. 7 is a graph illustrating an exemplary correlation between the amount of protrusion of the inner pad and the shape of a press-formed product.

Exemplary correlation data will be described below. The graph shown in FIG. 7 illustrates the relationship between the amount of protrusion H of the punch inner pad 9 and spring-back/spring-go. The difference in angle, represented by the vertical axis of the graph, indicates the difference between the angle θ1 formed by the top plate 12A and a flange 12E of the press-formed product 12 shown in FIG. 5, on one hand, and the reference value θc, i.e., 0 degrees in this case (θ1−θc (θc=0 degrees in this case)). The reference value θc is the angle formed by the top plate and a flange 12E when there is no spring-back nor spring-go. A positive difference in angle means spring-back, while a negative difference in angle means spring-go. In the relationship illustrated by the graph of FIG. 7, the appropriate value Ha of the amount of protrusion of the punch inner pad is the amount of protrusion for a difference in angle of zero.

Figure 8:
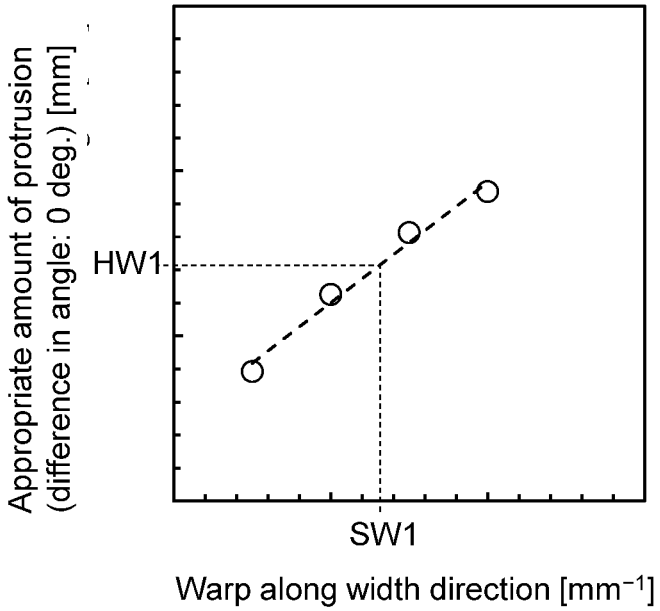
FIG. 8 is a graph illustrating an exemplary relationship between the appropriate amount of protrusion of the inner pad and the amount of warp in a blank along the width direction.

FIG. 8 is a graph illustrating an exemplary relationship between the appropriate amount of protrusion and the amount of warp in a blank along one direction. The vertical axis of the graph shown in FIG. 8 represents the amount of protrusion of the punch inner pad found when the difference in angle (θ1−θc) is zero, that is, when there is no spring-back nor spring-go. The horizontal axis represents the amount of warp in a blank along its width direction. The width direction of a blank is the direction corresponding to a direction perpendicular to the ridges of the grooved member and a direction perpendicular to the punch ridges. The inventors have found that, as shown in FIG. 8, there is a correlation between the amount of warp in a blank along its width direction and the appropriate amount of protrusion of the punch inner pad.

Figure 9:
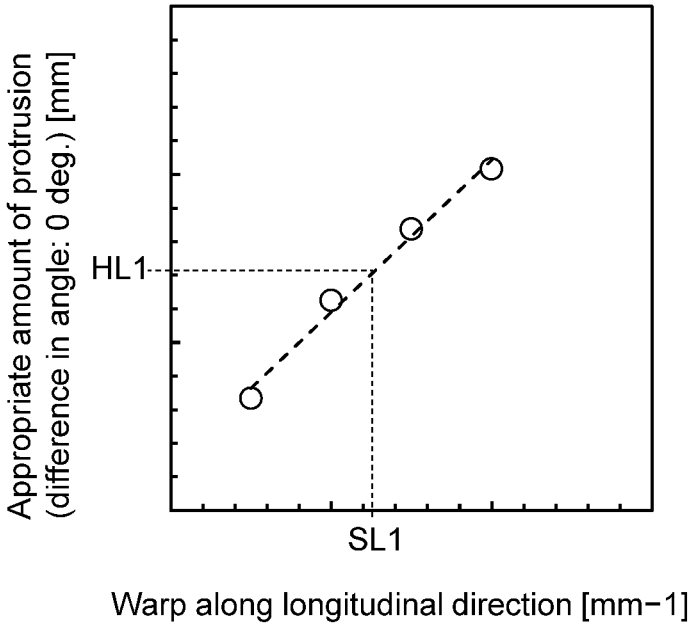
FIG. 9 is a graph illustrating an exemplary relationship between the appropriate amount of protrusion of the inner pad and the amount of warp in a blank along the longitudinal direction.

FIG. 9 is a graph illustrating an exemplary relationship between the appropriate amount of protrusion and the amount of warp in a blank along another direction. The vertical axis of the graph shown in FIG. 9 represents the amount of protrusion of the punch inner pad found when the difference in angle (θ1−θc) is zero, that is, when there is no spring-back nor spring-go. The horizontal axis represents the amount of warp in a blank along its longitudinal direction. The longitudinal direction of a blank is the direction corresponding to the direction of extension of the ridges of the grooved member and the direction of extension of the punch ridges. The inventors have found that, as shown in FIG. 9, there is a correlation between the amount of warp in a blank along its longitudinal direction and the appropriate amount of protrusion of the punch inner pad.

By way of example, an exemplary control of the amount of protrusion in a case where both the amount of warp in a blank along the width direction, SW1, and the amount of warp along the longitudinal direction, SL1, have been captured. In this case, the appropriate amount of protrusion corresponding to the amount of warp SW1 along the width direction obtained from the graph of FIG. 8, HW1, and the appropriate amount of protrusion corresponding to the amount of warp SL1 along the longitudinal direction obtained from the graph of FIG. 9, HL1, are summed up (HW1+HL1); and the appropriate amount of protrusion for no amount of warp along each of the longitudinal and width directions, Hao, is subtracted from that sum, and the result of this calculation is treated as the amount of protrusion H. The controller 11 controls the press equipment 5 such that the set value of the amount of stick-out of the punch inner pad 9 from the punch 7, i.e., amount of protrusion H, is (HW1+HL1−Hao). In this case, for example, equations expressing the lines in the graphs shown in FIGS. 8 and 9 or data indicating the plotted circles in the graphs are treated as correlation data.

Thus, the correlation data may contain data indicating the relationship between the amount of warp in a sheet along the width direction and the amount of warp in a sheet along the longitudinal direction, on one hand, and the appropriate amount of stick-out of the punch inner pad. The controller 11 may use this correlation data to determine the appropriate amount of protrusion based on the measured amounts of warp in a sheet along the width direction and longitudinal direction. This will enable more appropriate control of the amount of stick-out based on the amount of warp in a sheet along a direction that is particularly likely to affect the press-formed product.

(Exemplary Sheet Material)

The sheet to which the present invention is applicable is not limited to any particular material. The material of the sheet used may be, for example, a thin sheet format by a 980 MPa grade high-strength steel sheet (high-tensile-strength steel sheet). In recent years, press-formed products with higher and higher strengths have been developed to reduce the weight of press-formed products. Together with this, materials of press-formed products with higher and higher strengths have been developed, too. A material with a higher strength is more difficult to press-form into a desired shape. For example, in general, the higher the strength of a material, the larger spring-back tends to occur. The above embodiment reduces the deviations of the shapes of a plurality of press-formed products from a target shape and variations therein even with a sheet having a tensile strength of 980 MPa or higher.

Further, in general, when a steel sheet with a tensile strength of the 270 MPa grade and a 1.2 GPa-grade steel sheet are compared, for example, the 1.2 GPa-grade steel sheet generally tends to have larger variations in the amount of warp. Regardless of how the mold shape is adjusted such that the first press-formed product to be press-formed from a manufacture lot has a desired shape, the possibility of press-formed products that are subsequently press-formed from this manufacture lot not having the target shape is high if there are large variations in the amount of warp. According to the above embodiment, even if a sheet is used having a tensile strength of 980 MPa or higher, which experiences relatively large variations in material characteristics compared with a steel sheet with low strength, feedforward control of the amount of stick-out of the inner pad from the punch depending on the amount of warp reduces variations in shape among a plurality of press-formed products.

EXAMPLES

Figure 10:
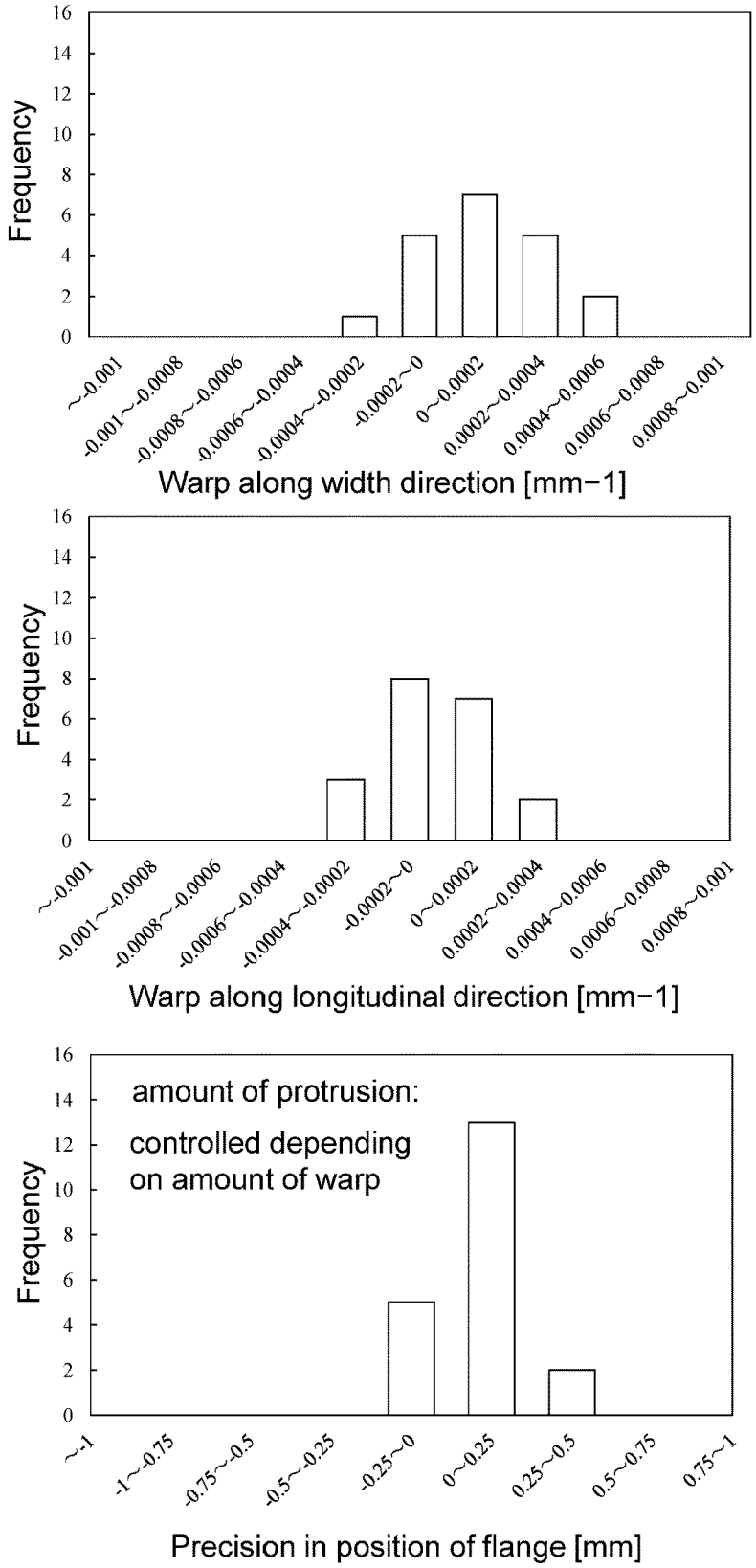
FIG. 10 shows histograms of the amount of warp and the precision in the position of a flange in implementations where feedforward control based on the amount of warp is performed.
Figure 11:
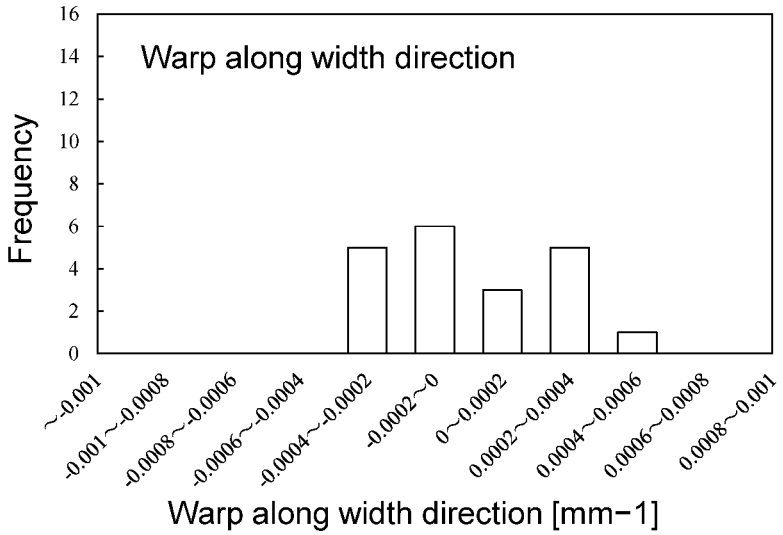
FIG. 11 shows histograms of the amount of warp and the precision in the position of a flange in implementations where no feedforward control based on the amount of warp is performed.
Figure 11:
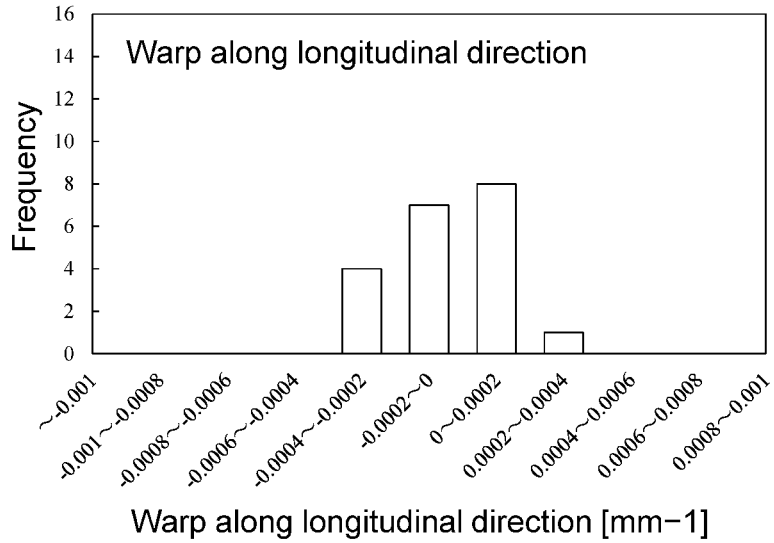
Figure 11:
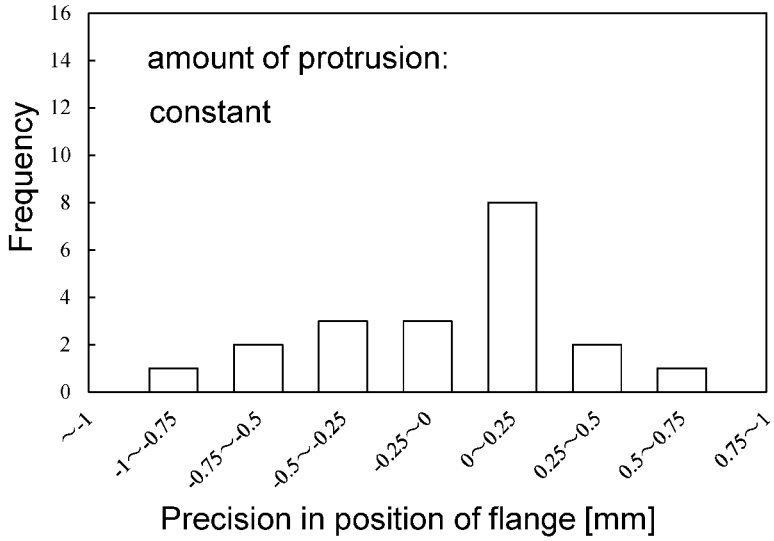

FIG. 10 shows histograms showing measurements of the precision in the position of a flange with feedforward control of the amount of protrusion H of the punch inner pad 9 depending on the amount of warp. FIG. 11 shows histograms showing measurements of the precision in the position of a flange without feedforward control of the amount of protrusion H of the punch inner pad 9. In each of FIGS. 10 and 11, the first histogram from the top shows the distribution of the amount of warp along the width direction for the blanks contained in one test lot. The warp in a blank along the width direction is randomly changed for each shot of press-forming within the range of approximately −0.0004 to 0.0006 $mm^{-1}$. The second histogram from the top shows the distribution of the amount of warp along the longitudinal direction for the blanks contained in one test lot. The warp in a blank along the longitudinal direction is randomly changed for each shot of press-forming within the range of approximately −0.0004 to 0.0004 $mm^{-1}$. The third histogram from the top shows the distribution of the precision in the position of a flange for one test lot. The precision in the position of a flange is the difference in the height of a flange (corresponding to T1 shown in FIG. 5). The precision in the position of a flange is expressed where the reference position that serves as the target is 0.0. The material of the blanks used was a steel sheet with a tensile strength of 1180 MPa.

For the examples shown in FIG. 10, the standard deviation of the warp in a blank along the width direction was 0.00023 $mm^{-1}$, the standard deviation of the warp in a blank along the longitudinal direction was 0.00018 $mm^{-1}$, and the standard deviation of the precision in the position of a flange was 0.12 mm.

For the examples shown in FIG. 11, the standard deviation of the warp in a blank along the width direction was 0.00024 $mm^{-1}$, the standard deviation of the warp in a blank along the longitudinal direction was 0.00016 $mm^{-1}$, and the standard deviation of the precision in the position of a flange was 0.36 mm.

These results demonstrate that feedforward control that controls the amount of protrusion (amount of stick-out) H of the punch inner pad 9 from the punch 7 depending on the amount of warp in the blank reduces the deviation of the shape of a press-formed product from a target shape and variations therein.

Although an embodiment of the present invention has been described, the above-described embodiment is provided merely by way of example to enable carrying out the present invention. Accordingly, the present invention is not limited to the above-described embodiment, and the above-describe embodiment, when carried out, can be modified appropriately without departing from the spirit of the invention.

For example, according to the above embodiment, the movable mold part for which the initial position is controlled depending on the amount of warp is an inner pad of a punch; alternatively, the initial position of a die pad provided on the die relative to the die may be controlled depending on the amount of warp.

According to the above embodiment, the warp-amount capturing device for capturing the amount of warp is a warp-amount measurement device. The warp-amount capturing device may be a device that acquires data indicating the amounts of warp in a plurality of sheets B to be pressed. For example, in implementations where a warp-amount measurement device is remotely located, the warp-amount capturing device may be configured to receive data indicating the amount of warp from the warp-amount measurement device or another communication device. The warp-amount capturing device may be included in the controller. That is, the controller may be configured to capture the amount of warp from an external device. The data indicating the amounts of warp in individual sheets is preferably data containing actual measurements of the amount of warp; however, the data indicating the amount of warp is not limited to data containing actual measurements.

EXPLANATION OF CHARACTERS

4: transportation device
5: press equipment
6: die
7: punch
8: die pads
9: punch inner pads (inner pads)
10: warp-amount measurement device
11: controller
12: press-formed product

The invention claimed is:

1. A method of manufacturing a press-formed product, comprising:

capturing an amount of warp in each of one or more sheets to be pressed separately; and press-forming each of the one or more sheets into the press-formed product using a die, a punch and a movable mold part, the movable mold part being capable of changing its position relative to both the die and the punch, wherein, during the press-forming of each of the one or more sheets, an initial position of the movable mold part relative to the die or the punch is controlled depending on the amount of warp in the sheet.

2. The method of manufacturing the press-formed product according to claim 1, wherein the press-forming includes successively press-forming each of the one or more sheets, and during at least one of the successive press-forming cycles, the initial position of the movable mold part relative to the die or the punch is controlled depending on the amount of warp in the respective one or more sheets.

3. The method of manufacturing the press-formed product according to claim 1, wherein the press-formed product is a grooved member including a top plate, walls extending from both ends of the top plate, and ridges each located between the top plate and an associated one of the walls, and the movable mold part includes an inner pad provided on a top of the punch, the method for each of the one or more sheets comprising:

placing the sheet between the die and the punch including the inner pad on its top;

setting the initial position of the inner pad relative to the punch based on the captured amount of warp;

with the initial position of the inner pad relative to the punch having been set, moving the die and the punch closer to each other to form the walls while a die corner of the die is sliding against the sheet; and with the inner pad pulled into the punch, compressing the sheet by means of the top of the punch and the die to form the top plate.

4. The method of manufacturing the press-formed product according to claim 3, wherein the amount of warp in the each of the one or more sheets is obtained by measuring a first amount of warp along a direction of extension of the ridges and a second amount of warp along a direction perpendicular to the ridges.

5. The method of manufacturing the press-formed product according to claim 1, further comprising:

for each of the one or more sheets:

acquiring correlation data indicating a correlation between the amount of warp in the sheet and the initial position of the movable mold part relative to the die or the punch; and using the correlation data to set the initial position of the movable mold part to correspond to the measured amount of warp in the sheet.

6. The method of manufacturing the press-formed product according to claim 3, wherein, for each of the one or more sheets, the walls are formed while the die corner of the die is sliding against the sheet along a distance 25 times a sheet thickness of the sheet or larger.

7. A press line comprising:

a warp-amount capturing device adapted to capture an amount of warp in each of one or more sheets to be pressed separately;

press equipment including a die, a punch and a movable mold part capable of moving relative to both the punch and the die; and a controller adapted to control the press equipment, wherein the controller is adapted, during press-forming of each of the one or more sheets by the die, the punch and the movable mold part of the press equipment, to control an initial position of the movable mold part relative to the die or the punch depending on the amount of warp in the sheet captured by the warp-amount capturing device.

8. The press line according to claim 7, wherein the warp-amount capturing device is a warp-amount measurement device adapted to measure the amount of warp in each of the one or more sheets.

9. The press line according to claim 8, wherein the punch includes a top portion, a side wall and a punch ridge located between the top portion and the side wall, and a direction of warp measurement by the warp-amount measurement device includes a direction parallel to the punch ridge and a direction perpendicular to the punch ridge.

10. The press line according to claim 9, wherein a height of the side wall of the punch is 25 times a minimum gap between the punch and the die or larger.

11. The press line according to claim 7, wherein the controller is configure to, for each of the one or more sheets, access a storage device storing correlation data indicating a correlation between the amount of warp in the sheet and the initial position of the movable mold part relative to the die or the punch.

* * * * *